US006895192B2

(12) United States Patent
Katoh et al.

(10) Patent No.: US 6,895,192 B2
(45) Date of Patent: May 17, 2005

(54) IMAGE FORMING APPARATUS AND DEVELOPER REPLENISHMENT CONTROL METHOD

(75) Inventors: Tetsuo Katoh, Yokohama (JP); Koichi Kuroyama, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 30 days.

(21) Appl. No.: 10/424,792

(22) Filed: Apr. 29, 2003

(65) Prior Publication Data

US 2003/0202806 A1 Oct. 30, 2003

(30) Foreign Application Priority Data

Apr. 30, 2002 (JP) ..... 2002-128879

(51) Int. Cl.[7] ..... G03G 15/08
(52) U.S. Cl. ..... 399/27; 399/30; 399/44
(58) Field of Search ..... 399/27, 30, 53, 399/358–360, 44

(56) References Cited

U.S. PATENT DOCUMENTS

| | | | | |
|---|---|---|---|---|
| 6,192,212 B1 | * | 2/2001 | Kunihiro et al. | 399/359 |
| 6,526,252 B1 | | 2/2003 | Itoh et al. | |
| 6,577,824 B2 | | 6/2003 | Itoh et al. | |
| 2003/0072580 A1 | | 4/2003 | Itoh et al. | |

FOREIGN PATENT DOCUMENTS

| | | | | |
|---|---|---|---|---|
| JP | 06110329 A | * | 4/1994 | G03G/15/08 |
| JP | 9-114218 A | | 5/1997 | |

* cited by examiner

*Primary Examiner*—Arthur T. Grimley
*Assistant Examiner*—Ryan Gleitz
(74) *Attorney, Agent, or Firm*—Foley & Lardner LLP

(57) ABSTRACT

After a toner empty state, toner is filled. Following the filling of toner, a forcible toner replenishment mode is performed. After release of the forcible toner replenishment mode, a printer CPU replenishes only fresh toner and does not replenish recycled toner while image formation is performed on a predetermined number of paper sheets or while a developing device is driven for a predetermined time.

18 Claims, 13 Drawing Sheets

IMAGE FORMING APPARATUS AND DEVELOPER REPLENISHMENT CONTROL METHOD

CROSS-REFERENCE TO RELATED APPLICATIONS

This application is based upon and claims the benefit of priority from the prior Japanese Patent Application No. 2002-128879, filed Apr. 30, 2002, the entire contents of which are incorporated herein by reference.

BACKGROUND OF THE INVENTION

1. Field of the Invention

The present invention relates to an image forming apparatus, such as a digital copying machine, which forms, by making use of an electrophotographic process, an image on a fed paper sheet.

2. Description of the Related Art

A conventional image forming apparatus using an electrophotographic process, for example, a digital copying machine, includes an image forming section which forms an image based on image data and outputs the image onto a recording medium such as paper.

The image forming apparatus has a photosensitive drum that carries thereon an electrostatic latent image corresponding to the image data. The image forming apparatus includes a charger for uniformly charging the surface of the photosensitive drum to a predetermined potential; a developing device for supplying a developer, i.e., a toner, to the electrostatic latent image that is formed by exposing the charged surface of the photosensitive drum, thus forming a toner image; a transfer belt for transferring the toner image from the photosensitive drum onto a recording medium such as a paper sheet; a drum cleaner for removing residual toner on the photosensitive drum after the transfer of the toner image; and a charge erase lamp for erasing the charge remaining on the photosensitive drum. These components are arranged around the photosensitive drum in the named order in the rotational direction of the photosensitive drum.

In a high-humidity environment, however, there arises such a problem that when toner is supplied to the developer, the rise in charge becomes slower than in a normal-humidity or low-humidity environment due to moisture-absorption of the toner (developer) itself. If image formation is performed in the state in which the supplied toner is not sufficiently charged, image fogging of the toner occurs. The image fogging, in this context, refers to a phenomenon where toner forms on an area that should normally become a white area in the image formation, and this area becomes gray.

In particular, in the case of recycled toner (recovered toner) once used for image formation, an external additive for controlling the charge amount has already been removed from the toner, so the phenomenon of image fogging becomes conspicuous, compared to fresh toner (new toner).

In a forcible toner replenishment mode that is performed for restoration from a toner empty state, a great deal of toner is supplied in a shorter time than in the normal mode, thus aggravating the phenomenon. To cope with the problem, there is a publicly known method in which replenishment of recycled toner is prohibited during this time, and only fresh toner is supplied.

In such a case, even when the forcible toner replenishment mode is finished and the normal mode is restored, the charge amount (level) of the developer is still lower than in the normal state and the replenishment of recycled toner results in frequent occurrence of image fogging.

BRIEF SUMMARY OF THE INVENTION

The object of the present invention is to provide an image forming apparatus and a developer replenishment control method, which are capable of performing high-quality image formation in any environment after release of a forcible toner replenishment mode.

In order to achieve the above object, the invention may provide an image forming apparatus having a photosensitive body that forms an electrostatic latent image, and forming an image, the apparatus comprising: a developing section that effects development on the photosensitive body with the formed electrostatic latent image by using a developer; a first replenishment section that replenishes fresh developer to the developing section; a second replenishment section that replenishes recovered developer to the developing section; a detection section that detects the state of the developer in the developing section; a first control section that effects control to replenish only fresh developer to the developing section from the first replenishment section in accordance with the detection result of the detection section for a predetermined time, when forcible replenishment of fresh toner to the developing section from the first replenishment section is completed; and a second control section that effects a control to replenish fresh toner from the first replenishment section and recovered developer to the developing section from the second replenishment section in accordance with the detection result of the detection section, when the predetermined time in which the control of the first control section is effected has elapsed.

This invention may also provide a developer replenishment control method for replenishing a developer to a developing section that effects development on a photosensitive body with an electrostatic latent image formed, the method comprising: effecting control to replenish only a fresh developer to the developing section in accordance with the detection result of the state of the developer in the detection section for a predetermined time; and effecting control to replenish fresh toner and recovered developer to the developing section in accordance with the detection result of the state of the developer in the detection section, when the predetermined time has elapsed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the accompanying drawings.

Figure 1:
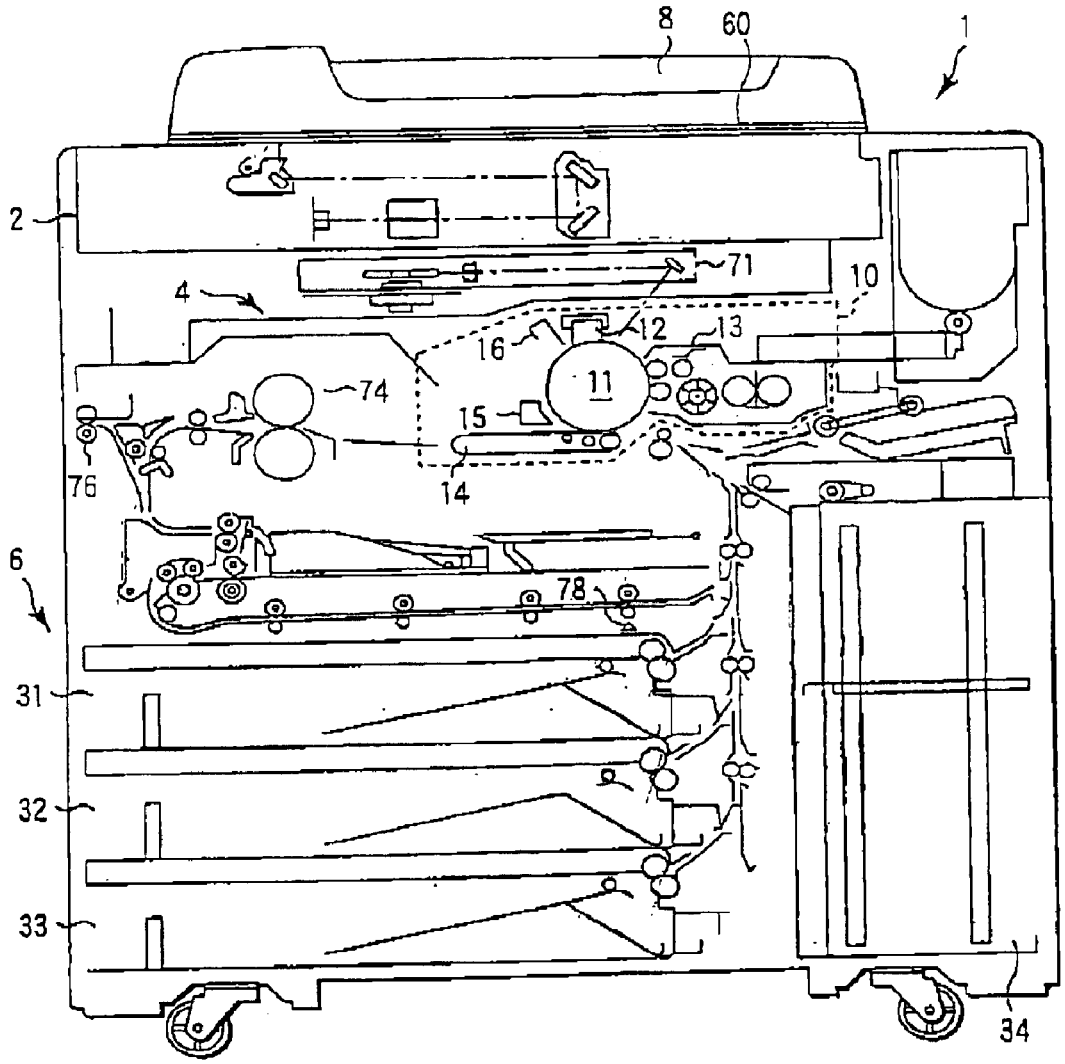
FIG. 1 is a cross-sectional view schematically showing the structure of a digital copying machine according to the present invention.

FIG. 1 schematically shows the structure of a digital copying machine 1 according to an embodiment of the present invention. As is shown in FIG. 1, the digital copying machine 1 includes a scanner section 2 for reading an image on an original and acquiring image data; a printer section 4 for printing out an image based on the image data acquired by the scanner section 2 onto a paper sheet; and a sheet feed section 6 for feeding a sheet of a desired size to the printer 4.

An automatic document feeder (ADF) 8 is openably provided on an upper part of the digital copying machine 1. The ADF 8 functions as a cover for holding an original placed on an original table 60, and successively feeds a plurality of originals onto the original table 60.

The printer section 4 comprises an exposing device 71 for emitting a laser beam based on image data acquired by the sheet feed section 6; an image forming section 10 for forming an image on a paper sheet fed by the sheet feed section 6; and a fixing device 74 for fixing a toner image on the sheet by heating and melting.

The sheet feed section 6 includes a plurality of sheet feed cassettes 31, 32 and 33 which contain sheets of different sizes, respectively, and a large-capacity feeder 34 capable of containing about 4000 paper sheets of a size for relatively frequent use, e.g., A4 size.

Figure 2:
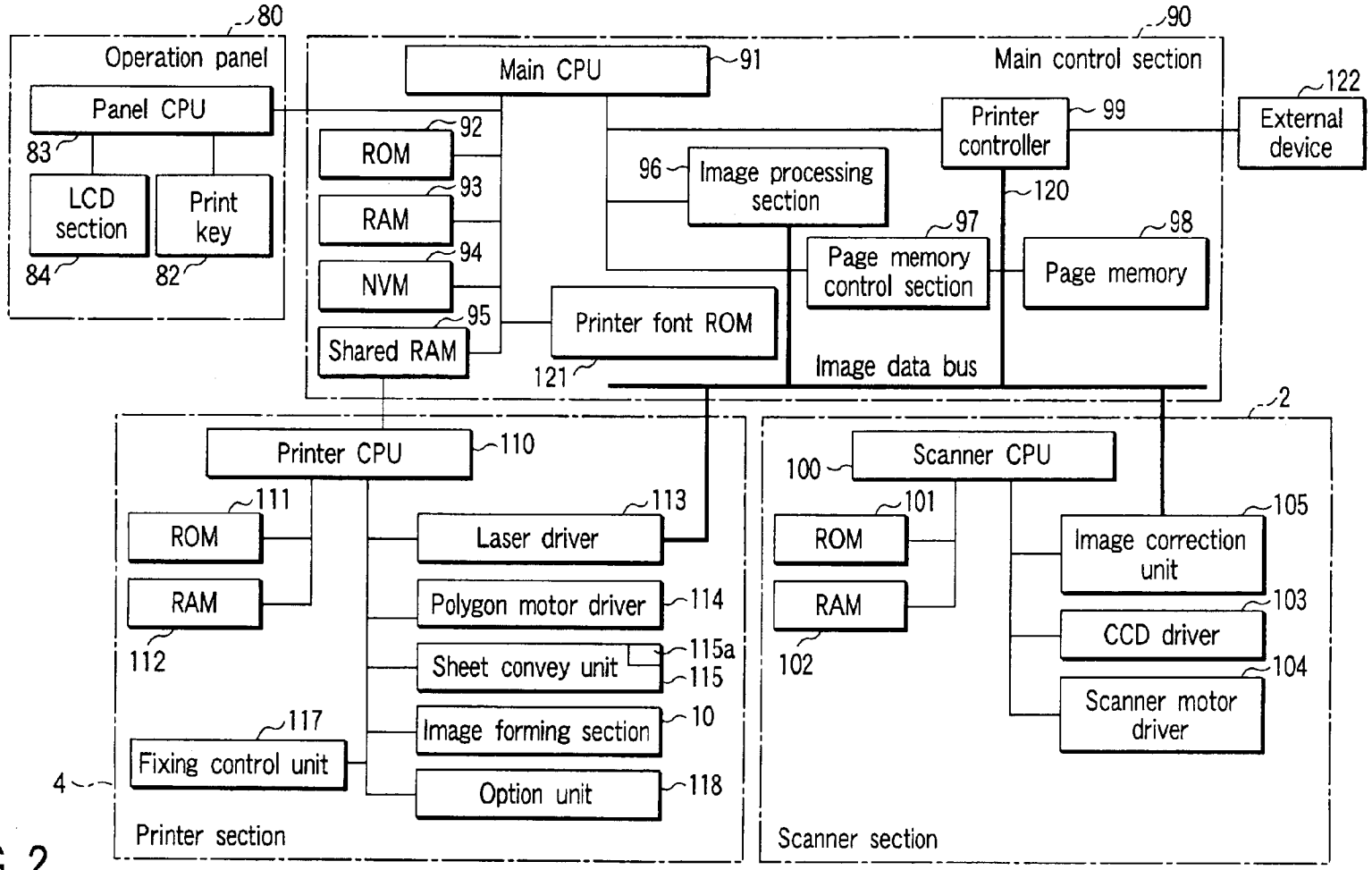
FIG. 2 is a block diagram schematically showing electrical connection in the digital copying machine.

FIG. 2 is a block diagram schematically showing electrical connection of the digital copying machine 1 shown in FIG. 1 and flow of signals for control. In FIG. 2, a control system of the digital copying machine 1 comprises three CPUs: a main CPU 91 provided in a main control section 90; a scanner CPU 100 in the scanner section 2; and a printer CPU 110 in the printer section 4.

The main CPU 91 performs bi-directional communication with the printer CPU 110 via a shared RAM 95. The main CPU 91 issues operational instructions, and the printer CPU 110 returns status data. Serial communication is performed between the printer CPU 110 and scanner CPU 100. The printer CPU 110 issues operational instructions, and the scanner CPU 100 returns status data.

An operation panel 80 is connected to the main CPU 91. The operation panel 80 comprises a print key 82, a panel CPU 83, and an LCD section 84 having a touch panel for operational inputs.

The main CPU 91 controls the entirety of the main control section 90. A ROM 92 stores control programs, etc. A RAM 93 temporarily stores data.

The printer section 4 comprises the printer CPU 110 for controlling the entirety of the printer section 4; a ROM 111 storing control programs, etc.; a data storage RAM 112; a laser driver 113 for driving a semiconductor laser (not shown) in the exposing device 71; a polygon motor driver 114 for controlling the rotation of a polygon motor (not shown) of the exposing device 71; a sheet conveying unit 115 for controlling conveyance of a sheet P along the conveying path; the aforementioned image forming section 10; a fixing control unit 117 for controlling a fixing device 24; and an option control unit 118.

The sheet conveying unit 115 has a counter 115*a* for counting the number of sheets conveyed.

Figure 3:
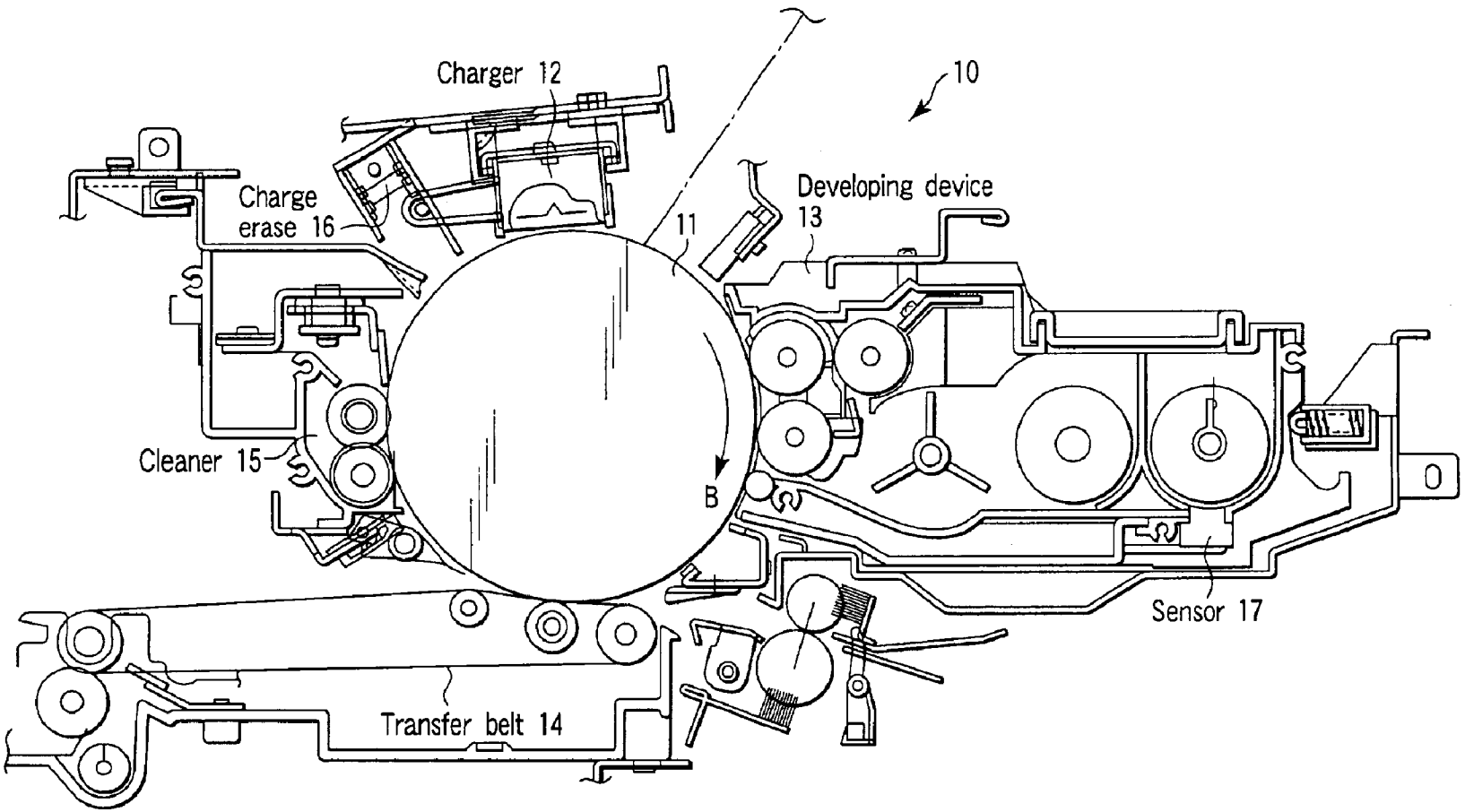
FIG. 3 shows a main part of an image forming section according to the present invention.

FIG. 3 shows a main part of the image forming section 10 according to the present invention. The image forming section 10 comprises a photosensitive drum 11, a charger 12, a developing device 13, a transfer belt 14, a drum cleaner 15 and a charge erasing lamp 16. As will be described later in detail, the developing device 13 includes a fresh toner replenishment device (not shown) and a recovered toner recycled mechanism (not shown).

In FIG. 3, the photosensitive drum 11 rotates clockwise (arrow B) during a copying operation.

The image forming section 10 adopts a reverse development method. To begin with, the charger 12 negatively charges the photosensitive drum 11. Then, the exposing device 71 exposes the photosensitive drum 11 with a laser beam. Thereby, the surface potential of the photosensitive drum 11 in a region corresponding to an image area of the original becomes close to zero in accordance with the density of image, and an electrostatic latent image is formed.

The digital copying machine 1 adopts a two-component development system. The developing device 13 contains a carrier and a toner (developer). The toner is replenished by a fresh toner replenishment device and a recovered toner recycled device, which will be described later, so that the ratio between the toner and the carrier may become about 5% (wt. %):about 95% (wt. %).

The amount of toner is always monitored by a toner density sensor 17 provided at a lower part of the developing device 13 shown in FIG. 3. If the ratio of toner in the developing device 13 decreases below 5%, the fresh toner replenishment device and recovered toner recycled device begin to operate to replenish a necessary amount of toner. The carrier and toner are fully stirred in the developing device 13, and the toner is negatively charged by frictional charge at the time of stirring.

If the latent image reaches the position of the developing device 13 by the rotation (direction B) of the photosensitive drum 11, the toner is attracted on the photosensitive drum 11 via the carrier and the latent image is developed into a visible toner image. The visible toner image is transferred onto a paper sheet that is conveyed from the sheet feed section 6 and positively pre-charged by the transfer belt 14.

The sheet with the transferred toner image is conveyed to the fixing device 74, while being attached to the transfer belt 14. The fixing device 74 melts and fixes the toner image on the sheet by thermo-compression. The sheet with the molten toner is discharged to the outside of the machine via an output roller 76.

Residual toner on the surface of the photosensitive drum 11, which has not been transferred onto the sheet, is recovered to the developing device 13 by the recovered toner recycled device (to be described later). To be more specific, the recovered toner removed by the cleaner 15 is conveyed to the front side by a recovered toner convey auger (to be described later) of the cleaner 15. Further, the recovered toner is conveyed to a recovered toner sub-hopper (to be described later). At last, the recovered toner is replenished from the recovered toner sub-hopper to the developing device 13.

Residual charge on the photosensitive drum 11 is erased by the charge erase lamp 16.

Figure 4:
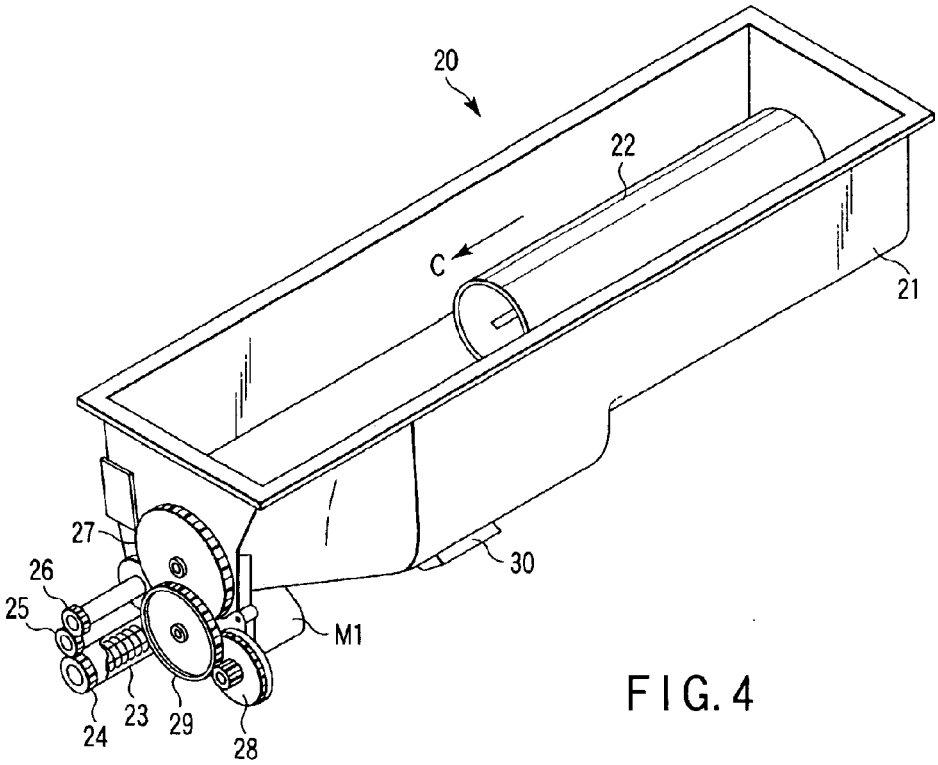
FIG. 4 is a perspective view showing the structure of a main part of a fresh toner replenishment device.

FIG. 4 is a perspective view showing the structure of a main part of a fresh toner replenishment device 20 according to the present invention. The fresh toner replenishment device 20 is disposed perpendicular to the developing device 13 on the front side of the body of the digital copying machine 1.

A toner container 21 of the fresh toner replenishment device 20 has a substantially semi-cylindrical shape (a nearly half portion with a shallow depth, and the rest with a greater depth). The shallow portion is provided with two stirring/conveying paddles 22.

With rotation of the stirring/conveying paddles 22, fresh toner (new toner) contained in the toner container 21 is conveyed in the direction of arrow C in FIG. 4. In addition, with rotational motion of a toner conveying auger 23, the fresh toner is conveyed to a mixer extension nozzle section (to be described later) of the developing device 13 by a helical blade of the toner conveying auger 23.

A drive mechanism for the toner conveying auger 23 is configured such that mechanical power is transmitted from a fresh toner hopper replenishment motor M1 to a gear 24 of the toner conveying auger section via a belt drive mechanism 28 for deceleration and gear drive mechanisms 25, 26, 27 and 29.

A shaft of the gear drive mechanism 27 is attached to a stir rod (not shown) for effecting stirring inside the toner container 21. The stir rod is configured to rotate in synchronism with the rotation of the fresh toner hopper replenishment motor M1.

A residual toner amount sensor 30 is provided at a lower part of the toner container 21.

Figure 5:
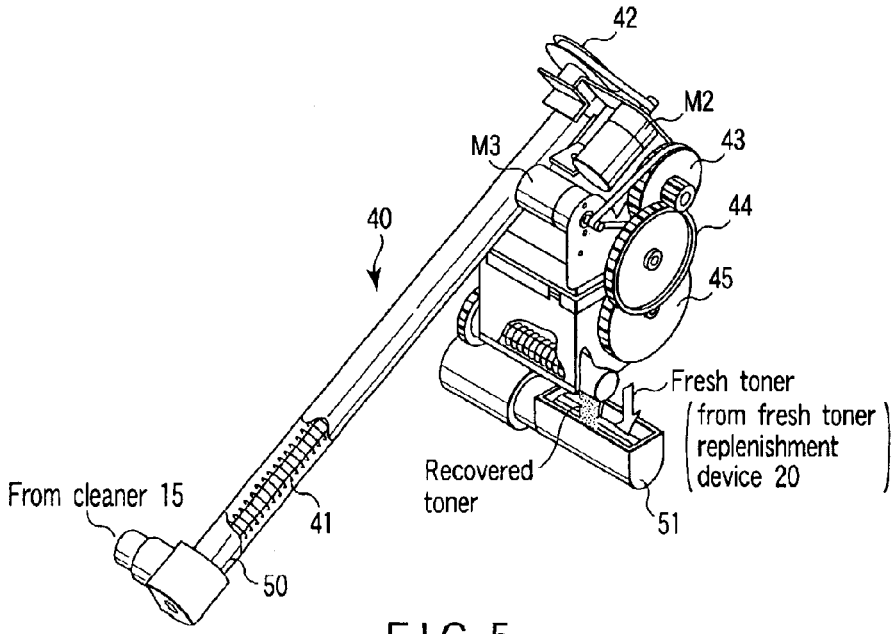
FIG. 5 is a perspective view showing the structure of a main part of a recovered toner recycled device.

FIG. 5 is a perspective view showing the structure of a main part of a recovered toner recycled device 40 according to the present invention. The recovered toner recycled device 40 is disposed on the front side of the developing device 13.

The recovered toner recycled device 40 comprises a coupling/conveying auger 41, a coupling pipe 50, a recycled toner sub-hopper 46 and a recovered toner replenishment auger 49, thereby conveying recovered toner, which is recovered by the cleaner 15, to the developing device 13.

Both the coupling/conveying auger 41 and recovered toner replenishment auger 49 rotate and convey recycled toner (recovered toner) by their own helical blades. A drive mechanism for the coupling/conveying auger 41 comprises a coupling/conveying auger drive motor M2, and a belt drive mechanism 42 for deceleration.

A drive mechanism for a stirring rod (not shown) in the recycled toner sub-hopper 46 is coupled to a stirring rod drive gear 45 via a sub-hopper drive motor M3, a belt drive mechanism 43 for deceleration and a gear drive mechanism 44. A drive mechanism for the recovered toner replenishment auger 49 is configured such that an auger drive gear is meshed with a gear (not shown) fitted on the shaft of the stirring rod drive gear 45.

The replenishment positions of the fresh toner (new toner) and recovered toner are set on the front side of the developing device 13 along a mixer extension nozzle 51 of the developing device such that the fresh toner is replenished on the upstream side, relative to the recovered toner, in the direction of conveying toner.

After the fresh toner and recovered toner are replenished to the mixer extension nozzle 51 of the developing device, these toners are sufficiently stirred and mixed by a stirring/conveying mixer (not shown) and the mixture is further mixed with the developer in the developing device 13.

Figure 6:
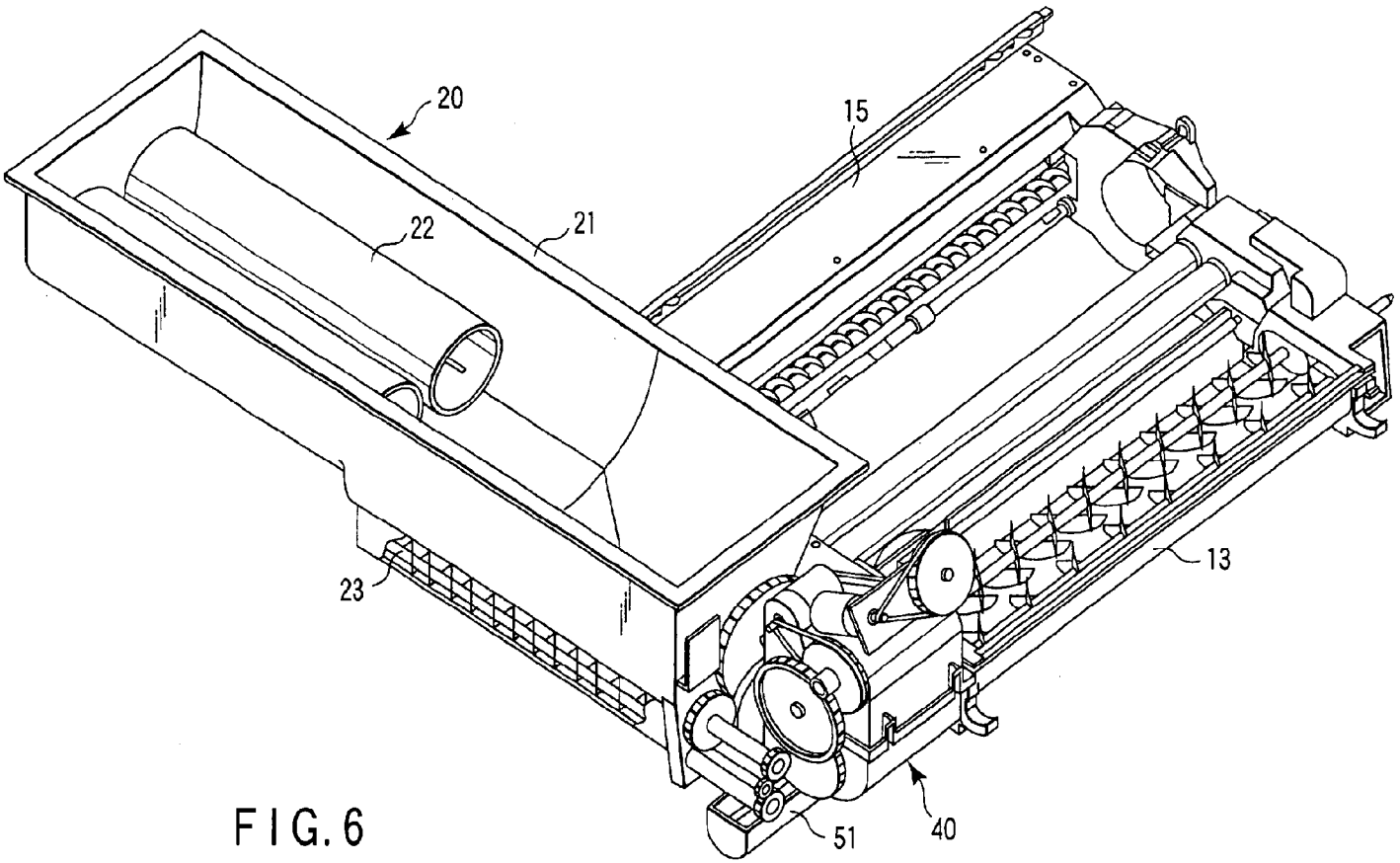
FIG. 6 shows whole structures of the developing device, fresh toner replenishment device and recovered toner recycled device.

FIG. 6 shows whole structures of the developing device 13, fresh toner replenishment device 20 and recovered toner recycled device 40. In FIG. 6, the developing device 13 is provided at the bottom, the recovered toner recycled device 40 is provided on the lower side, and the fresh toner replenishment device 20 is provided on the left side.

Figure 7:
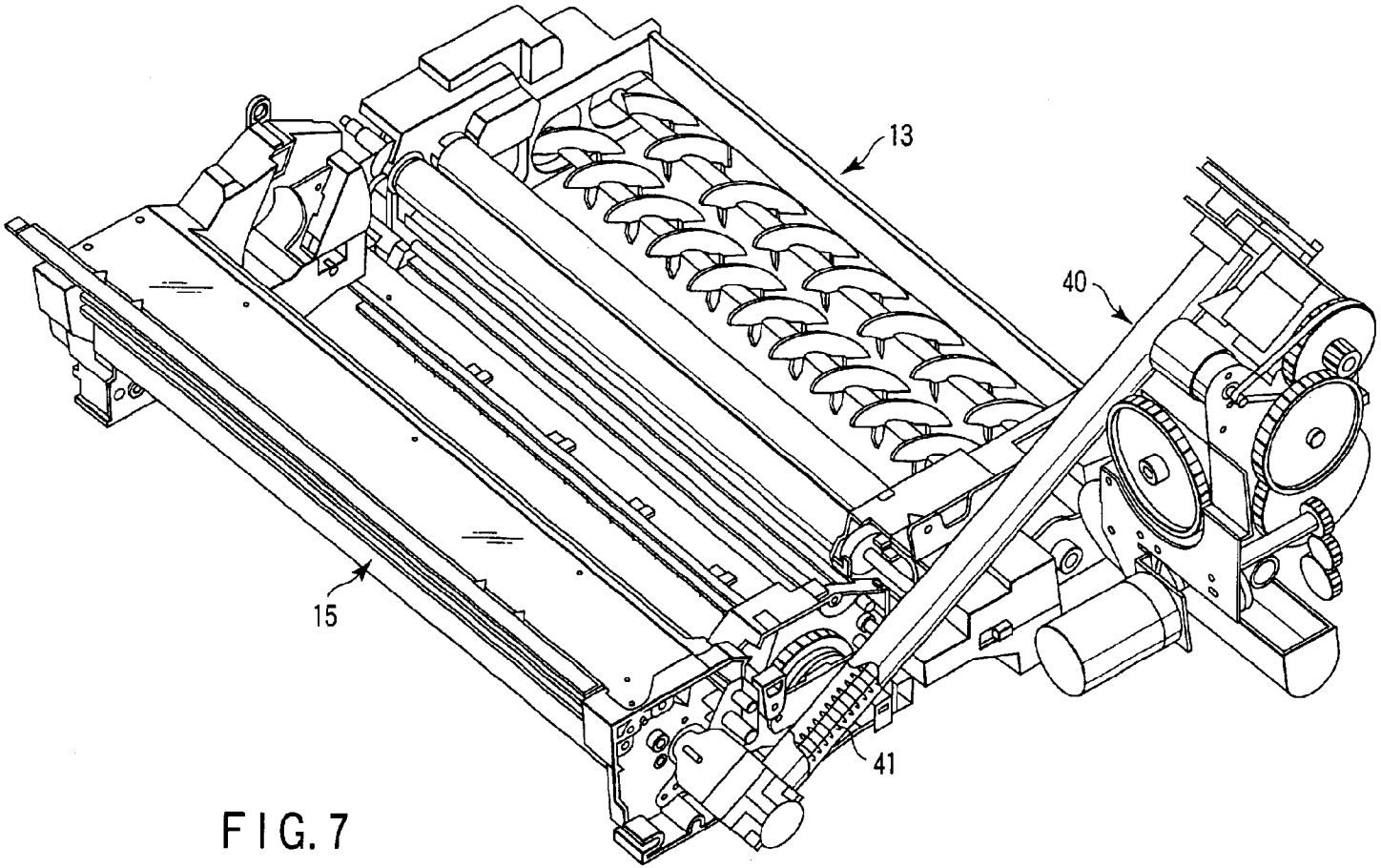
FIG. 7 shows whole structures of the developing device and recovered toner recycled device.

FIG. 7 shows whole structures of the developing device 13 and recovered toner recycled device 40. For easier understanding of the structures, FIG. 7 omits depiction of the fresh toner replenishment device 20. In FIG. 7, the developing device 13 is provided at the bottom, and the recovered toner recycled device 40 is provided on the right side.

Figure 8:
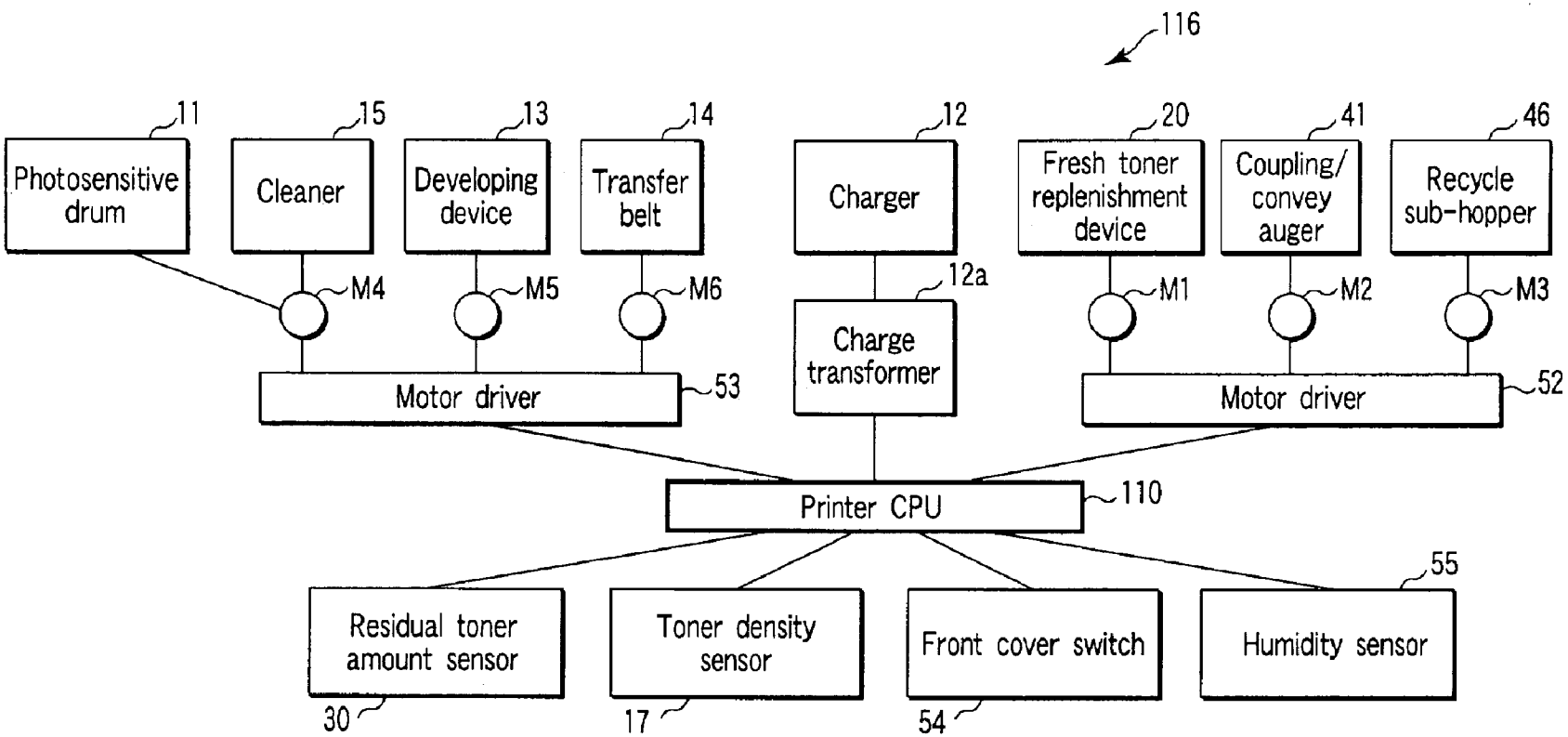
FIG. 8 is a block diagram showing a control configuration of the image forming section according to the present invention.

FIG. 8 is a block diagram showing a control configuration of the image forming section 10 according to the present invention. The image forming section 10 is controlled by the printer CPU 110.

At the time of printing, the printer CPU 110 controls a motor driver 53 and the motor driver 53 drives a drum motor M4 to activate the photosensitive drum 11 and cleaner 15.

Similarly, the printer CPU 110 controls the motor driver 53, and the motor driver 53 drives a motor M5 to activate the developing device 13. The printer CPU 110 controls the motor driver 53, and the motor driver 53 drives a transfer belt motor M6 to activate the transfer belt 14.

Besides, the printer CPU 110 controls a motor driver 52, and the motor driver 52 drives the fresh toner hopper replenishment motor M1 to activate the fresh toner replenishment device 20. The printer CPU 110 controls the motor driver 52, and the motor driver 52 drives the coupling/conveying auger drive motor M2 to activate the coupling/conveying auger 41. The printer CPU 110 controls the motor driver 52, and the motor driver 52 drives the recycled toner hopper replenishment motor M3 to activate the recycled toner sub-hopper 46.

The fresh toner hopper replenishment motor M1 is driven to cause the fresh toner replenishment device 20 to replenish fresh toner to the developing device 13.

The recycled toner hopper replenishment motor M3 is driven to replenish recycled toner from the recycled toner sub-hopper 46 of the recovered toner recycled device 40 to the developing device 13.

At the time of, e.g. printing, the printer CPU 110 controls a charge transformer 12*a*, and the charge transformer 12*a* applies a high voltage to the charger 12. Thus, the charger 12 charges the photosensitive drum 11.

The residual toner amount sensor 30 detects the residual toner amount in the toner container 21 by means of a reed switch. When the residual toner amount is large, toner intervenes between a magnet (not shown) and the reed switch and a gap is created therebetween. Thereby, the reed switch is turned off. If the residual toner amount decreases, the gap is eliminated and the reed switch is turned on by the magnet. This state is detected by the printer CPU 110.

The toner density sensor 17 is a sensor for detecting the ratio between carrier (iron) and toner (resin) in the developing device 13. If the printer CPU 110 detects that the toner density has lowered, on the basis of the output from the toner density sensor 17, the printer CPU 110 drives the fresh toner hopper replenishment motor M1, thus replenishing toner to the developing device 13. In the case where replenishment of toner is impossible, the printer CPU 110 causes the LCD section 84 of operation panel 80 to display "TONER EMPTY" and notifies the user.

A front cover switch 54 is a switch that is turned on/off by the opening/closing of the front cover (not shown). The printer CPU 110 detects the state of the front cover (not shown) on the basis of an input signal from the front cover switch 54.

A humidity sensor 55 is a sensor for detecting the humidity environment in the digital copying machine 1. The humidity sensor 55 is provided near the developing device 13. The printer CPU 110 performs control, which is described later, in accordance with the detection result of the humidity sensor 55.

Fresh toner is stored in the toner container 21. Recovered toner, which is recovered by the cleaner 15, is conveyed by the coupling/conveying auger 41 and stored in the recycled toner sub-hopper 46.

Toner is replenished into the developing device 13 when the toner density sensor 17 provided on the developing device 13 has detected the toner relative density in the developer and the detected toner relative density is lower than a reference value.

In this case, the printer CPU 110 performs rotation control for a predetermined time for the fresh toner hopper replenishment motor M1 provided on the fresh toner replenishment device 20 and the sub-hopper motor M3 provided on the recycled toner sub-hopper 46.

If the amount of fresh toner in the toner container 21 of the fresh toner replenishment device 20 decreases and the supply amount of toner to the developing device 13 decreases, the toner relative density in the developer in the developing device 13 gradually decreases by the image forming operations.

Assume, for example, that the output from the toner density sensor 17 is 5.0 V at the time of a reference toner relative density. If the output from the toner density sensor 17 rises to 5.8 V due to a decrease of about 1 wt. % of the toner relative density, the printer CPU 110 causes the LCD section 84 to display toner empty information as user information and, at the same time, stops the image forming operation.

When the printer CPU 110 detects power-on or closing of the cover (not shown) by means of the front cover switch 54 after fresh toner is filled in the toner container 21 of fresh toner replenishment device 20, the printer CPU 110 starts a forcible toner replenishment mode.

The forcible toner replenishment mode, in this context, means a mode in which the stir mixer (not shown) of the developing device 13 is rotated while the image forming operation is halted, and the replenishment operation for replenishing fresh toner from the toner container 21 is quickly completed. For this purpose, fresh toner is continuously replenished into the developing device 13, compared to the amount of replenishment during the image forming operation.

While toner is being replenished in the forcible toner replenishment mode, the toner density sensor 17 monitors the toner relative density in the developing device 13. If the output from the toner density sensor 17 has lowered to 5.0 V, which is the reference toner relative density, the printer CPU 110 stops the forcible toner replenishment mode and causes the LCD section 84 to display user information to the effect that image formation can be performed.

The forcible toner replenishment mode is a mode in which the developer toner relative density in the developing device 13 can be restored to the reference value in a short time. On the other hand, since a greater amount of toner is replenished in a short time than in the normal mode, there may be a case where the toner replenished in the developing device 13 fails to have a predetermined normal charge amount by stirring. If toner with low potential is conveyed to the development sleeve and used for development, image fogging of toner occurs.

This phenomenon tends to occur more frequently with respect to recycled toner, whose external additive has been removed, than fresh toner. In an example of publicly known art, in a forcible toner replenishment mode, only fresh toner is replenished and replenishment of recycled toner is stopped. Thereby, even in an image forming operation after the release from the forcible toner replenishment mode, image formation with less image fogging can be performed.

However, in a high-humidity environment, there arises such a problem that the charge amount of the developer becomes lower than in the normal-humidity environment due to the moisture-absorption action of the developer. Even with the above control, image fogging may frequently occur in image formation after the release from the forcible toner replenishment mode.

Figure 9:
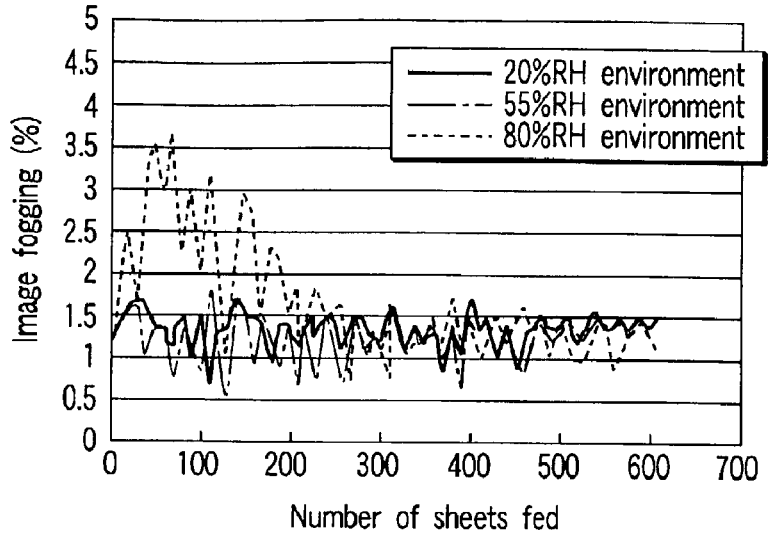
FIG. 9 is a graph showing image fogging in environments with different humidities.

FIG. 9 shows image fogging in environments with different humidities. Specifically, FIG. 9 shows the occurrence of image fogging after completion of the forcible toner replenishment mode in a normal-humidity environment (55% RH), the occurrence of image fogging after completion of the forcible toner replenishment mode in a high-humidity environment (80% RH), and the occurrence of image fogging after completion of the forcible toner replenishment mode in a low-humidity environment (20% RH).

In the low-humidity environment with a humidity of 20% and the normal-humidity environment with a humidity of 55%, the probability of occurrence of image fogging is low even after the completion of the forcible toner replenishment mode. On the other hand, in the high-humidity environment with a humidity of 80%, image fogging frequently occurs in a range of the number of sheets between zero (i.e., the start of the image forming operation following the completion of the forcible toner replenishment mode) and 250. It is thus understood that the image fogging occurs in part because of the difference in environment.

Figure 10:
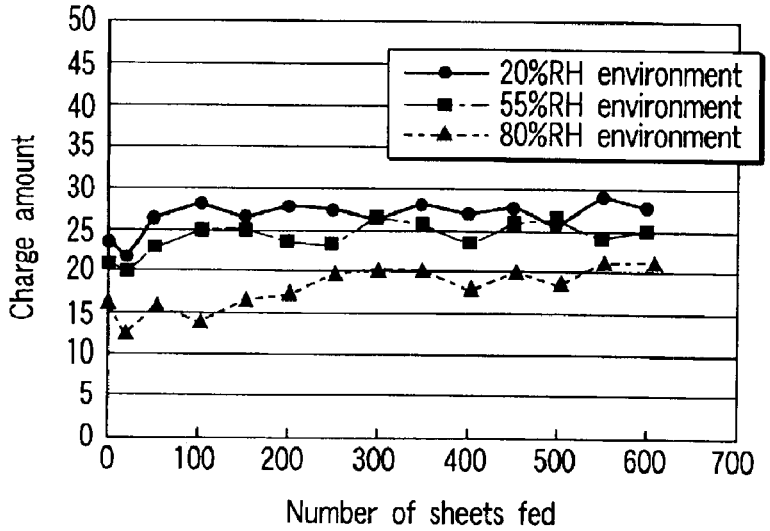
FIG. 10 is a graph showing a variation in charge amount of developer.

FIG. 10 is a graph showing a variation in charge amount of developer. In FIG. 10, the charge amount of developer differs between an environment with a humidity of 20%, an environment with a humidity of 55%, and an environment with a humidity of 80%. As is understood from FIG. 10, the variance in occurrence in image fogging due to the difference in environment results from the fact that the charge amount of developer after the restoration from the toner empty state is lower in the high-humidity environment than in the normal-humidity environment or in the low-humidity environment. The reason why the probability of occurrence of image fogging decreases after the image formation on 250 sheets, even in the high-humidity environment, can be explained by the following fact: that is, the charge amount of developer increases by stirring of the developer in the developing device 13 while image forming operations are performed on 250 sheets.

Figure 11:
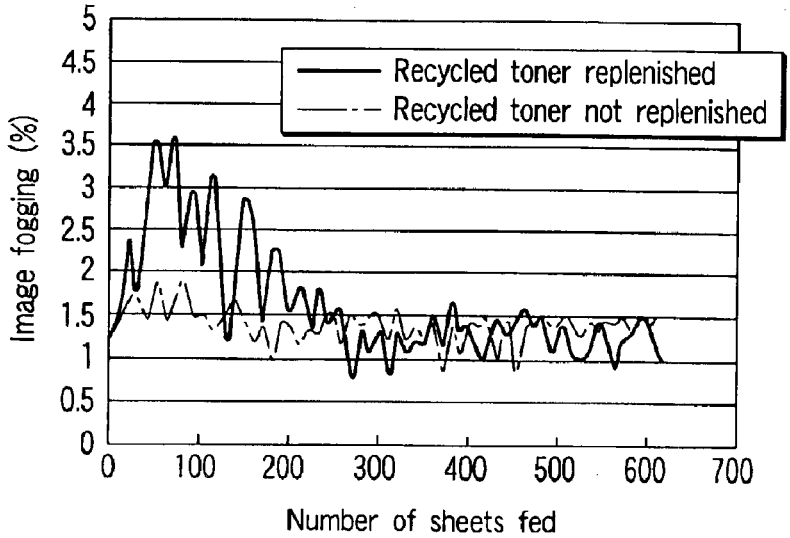
FIG. 11 is a graph showing occurrence of image fogging in an environment with a humidity of 80% after release of a forcible toner replenishment mode.

FIG. 11 is a graph showing occurrence of image fogging in an environment with a humidity of 80% after release of the forcible toner replenishment mode. In FIG. 11, a solid line indicates the occurrence of image fogging in the case where recycled toner replenishment was done after the release of the forcible toner replenishment mode, and a dot-and-dash line indicates the occurrence of image fogging in the case where the recycled toner replenishment was stopped and only fresh toner replenishment was done after the release of the forcible toner replenishment mode.

It is understood that the occurrence of image fogging is low if recycled toner is not replenished and only fresh toner is replenished after the release of the forcible toner replenishment mode in the high-humidity environment. Accordingly, it is understood that the probability of occurrence of image fogging increases if recycled toner is replenished while the charge amount of the developer is low.

The present invention uses an already proposed control in which recycled toner replenishment is stopped in the forcible toner replenishment mode, and additionally uses control in which recycled toner replenishment is stopped for a predetermined time period (corresponding to image formation on a predetermined number of sheets) during the image formation, even after the release from the forcible toner replenishment mode.

Figure 12:
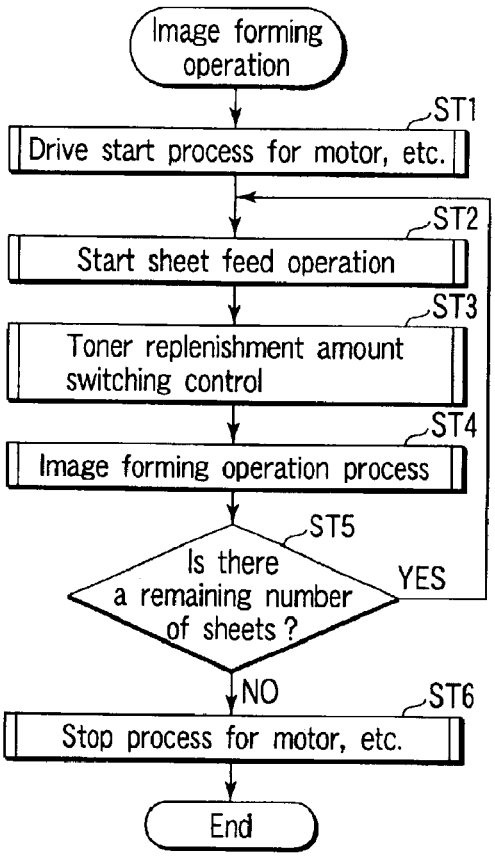
FIG. 12 is a flowchart illustrating an image forming operation.

The image forming operation in the above-described structure will now be described with reference to a flowchart of FIG. 12.

When an image forming operation has been started, e.g. upon depression of the print key 82, the printer CPU 110 starts driving the motors, etc., using the image forming section 10 (ST1), and starts a sheet feed operation using the sheet conveying unit 115 (ST2).

The printer CPU 110 then performs toner replenishment amount switching control (to be described later) (ST3), thus carrying out an image forming operation process (ST4).

Following the completion of the image forming operation process, if there is a remaining number of sheets set by the operation panel 80, the printer CPU 110 returns to step ST2. If not, the printer CPU 110 finishes the image forming operation process (ST6) by stopping the motors, etc., using the image forming section 10 (ST6).

Figure 13:
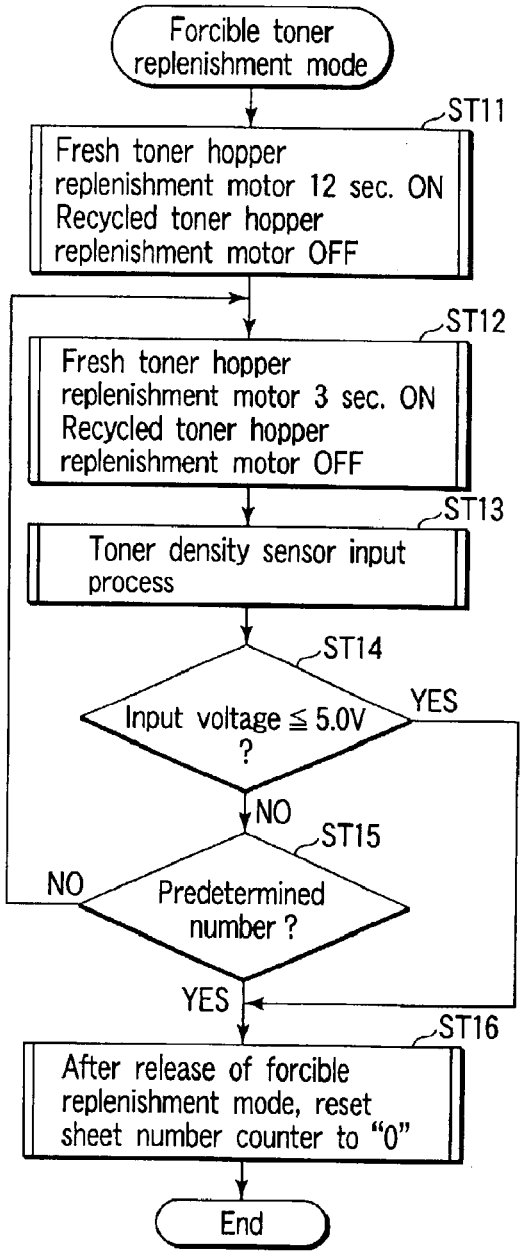
FIG. 13 is a flowchart illustrating an operation in the forcible toner replenishment mode.

Next, the forcible toner replenishment mode operation will be described with reference to a flowchart of FIG. 13. As mentioned above, the forcible toner replenishment mode starts after the toner supply amount to the developing device 13 decreases and fresh toner is filled.

When the forcible toner replenishment mode is initiated, the printer CPU 110 turns on the fresh toner hopper replenishment motor M1 of the fresh toner replenishment device 20 for 12 seconds, while turning off the sub-hopper drive motor M3 of the recycled toner sub-hopper 46 (ST11).

Subsequently, the printer CPU 110 turns off the fresh toner hopper replenishment motor M1 for three seconds, and keeps the sub-hopper drive motor M3 turned off (ST12).

The printer CPU 110 performs a toner density sensor input process in connection with the input from the toner density sensor 17 (ST13) and confirms whether the input voltage is equal to or less than 5.0 V (ST14). If the input voltage is equal to or less than 5.0 V, the printer CPU 110 advances to step ST16. If the input voltage is greater than 5.0 V, the printer CPU 110 determines whether a predetermined number of operations have been performed (ST15). If the predetermined number of operations have not been performed, the printer CPU 110 returns to step ST12. If the predetermined number of operations have been performed, the printer CPU 110 advances to step ST16.

In step ST16, the printer CPU 110 releases the forcible toner replenishment mode, resets the counter 115*a*, which counts the number of sheets fed, to zero, and finishes the forcible toner replenishment mode.

Figure 14:
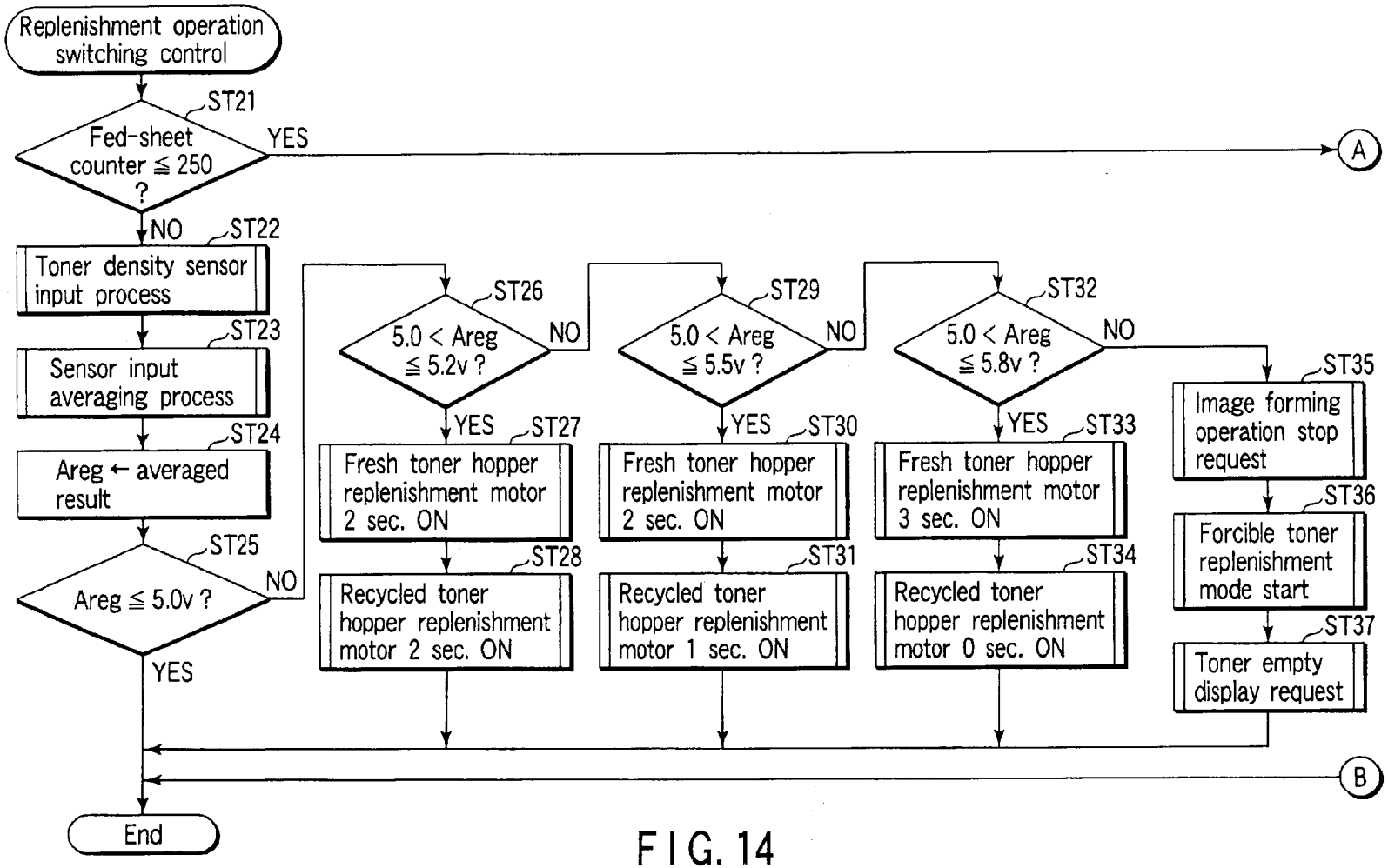
FIG. 14 is a flowchart illustrating toner replenishment operation switching control according to a first embodiment.
Figure 15:
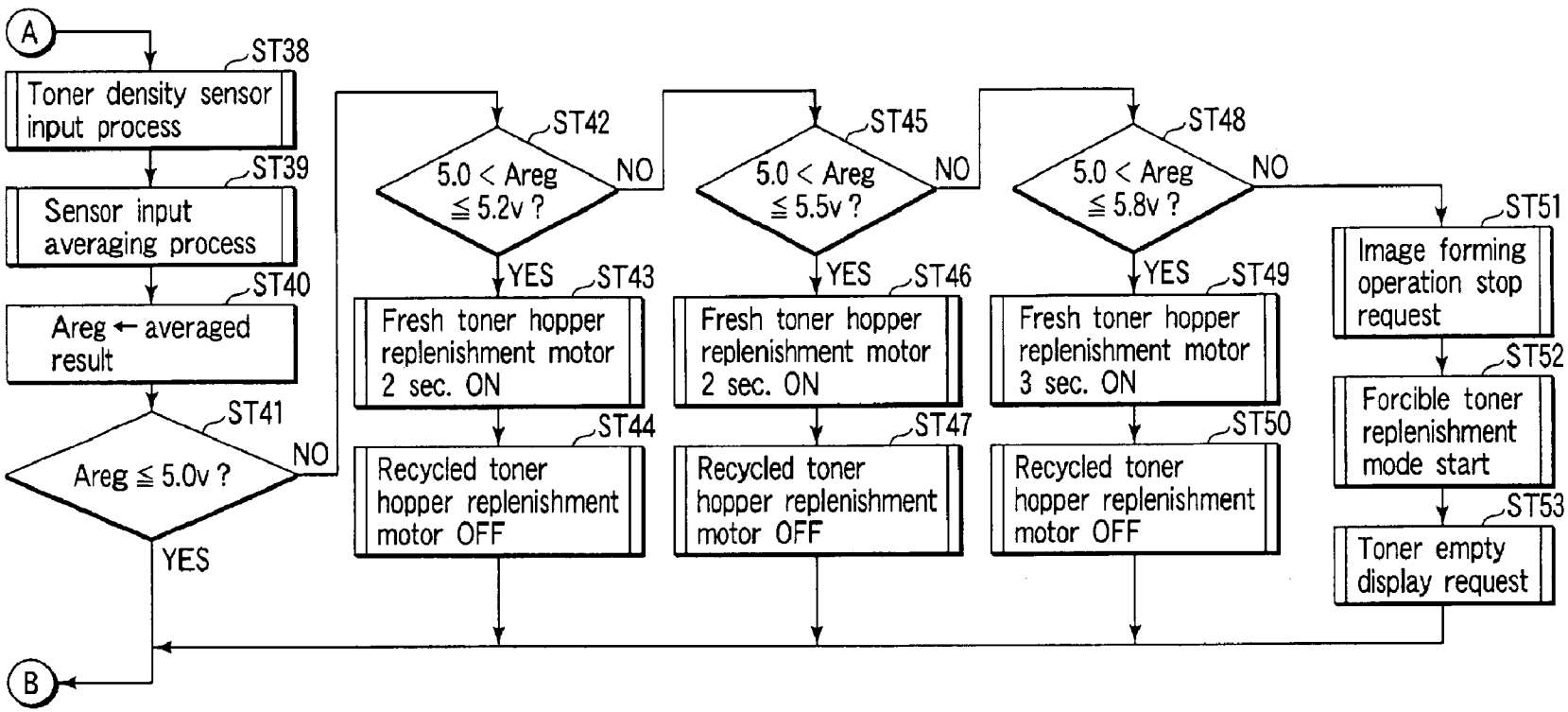
FIG. 15 is a flowchart illustrating toner replenishment operation switching control according to the first embodiment.

The toner replenishment operation switching control in the first embodiment of the present invention will now be described with reference to the flowcharts of FIG. 14 and FIG. 15.

When the forcible toner replenishment mode is released, the printer CPU 110 confirms the count value of the counter 115*a* (ST21).

If the count value of the counter 115*a* is "250" (number of sheets fed) or more, the printer CPU 110 performs the toner density sensor input process in connection with the input from the toner density sensor 17 (ST22). The printer CPU 110 averages the input value from the toner density sensor 17 (ST23) and temporarily stores (Areg) the averaged result (ST24).

The printer CPU 110 determines whether the temporarily stored averaged result is equal to or less than 5.0 V (ST25). If it is equal to or less than 5.0 V, the printer CPU 110 finishes the replenishment operation switching control.

If the temporarily stored averaged value is greater than 5.0 V in step ST25, the printer CPU 110 determines whether it is greater than 5.0 V and is equal to or less than 5.2 V (ST26). If the temporarily stored averaged value is greater than 5.0 V and is equal to or less than 5.2 V, the printer CPU 110 turns on the fresh toner hopper replenishment motor M1 for two seconds (ST27), turns on the recycled toner hopper, replenishment motor M3 for two seconds (ST28), and finishes the replenishment operation switching control.

If the temporarily stored averaged value is greater than 5.2 V in step ST26, the printer CPU 110 determines whether it is greater than 5.2 V and is equal to or less than 5.5 V (ST29). If the temporarily stored averaged value is greater than 5.2 V and is equal to or less than 5.5 V, the printer CPU 110 turns on the fresh toner hopper replenishment motor M1 for two seconds (ST30), turns on the recycled toner hopper replenishment motor M3 for one second (ST31), and finishes the replenishment operation switching control.

If the temporarily stored averaged value is greater than 5.5 V in step ST29, the printer CPU 110 determines whether it is greater than 5.5 V and is equal to or less than 5.8 V (ST32). If the temporarily stored averaged value is greater than 5.5 V and is equal to or less than 5.8 V, the printer CPU 110 turns on the fresh toner hopper replenishment motor M1 for 3 seconds (ST33), turns on the recycled toner hopper replenishment motor M3 for zero seconds (i.e. stops the motor M3) (ST34), and finishes the replenishment operation switching control.

If the temporarily stored averaged value is greater than 5.8 V in step ST32, the printer CPU 110 requests the main CPU 91 to stop the image forming operation (ST35), starts the forcible toner replenishment mode (ST36), requests the main CPU 91 to display toner empty information (ST37), and finishes, the replenishment operation switching control.

If the count value of the counter 115*a* is between zero and "250" (number of sheets fed), the printer CPU 110 performs the toner density sensor input process in connection with the input from the toner density sensor 17 (ST38). The printer CPU 110 averages the input value from the toner density sensor 17 (ST39) and temporarily stores (Areg) the averaged result (ST40).

The printer CPU 110 determines whether the temporarily stored averaged result is equal to or less than 5.0 V (ST41). If it is equal to or less than 5.0 V, the printer CPU 110 finishes the replenishment operation switching control.

If the temporarily stored averaged value is greater than 5.0 V in step ST41, the printer CPU 110 determines whether it is greater than 5.0 V and is equal to or less than 5.2 V (ST42). If the temporarily stored averaged value is greater than 5.0 V and is equal to or less than 5.2 V, the printer CPU 110 turns on the fresh toner hopper replenishment motor M1 for two seconds (ST43), turns off the recycled toner hopper replenishment motor M3 (ST44), and finishes the replenishment operation switching control.

If the temporarily stored averaged value is greater than 5.2 V in step ST42, the printer CPU 110 determines whether it is greater than 5.2 V and is equal to or less than 5.5 V (ST45). If the temporarily stored averaged value is greater than 5.2 V and is equal to or less than 5.5 V, the printer CPU 110 turns on the fresh toner hopper replenishment motor M1 for two seconds (ST46), turns off the recycled toner hopper replenishment motor M3 (ST47), and finishes the replenishment operation switching control.

If the temporarily stored averaged value is greater than 5.5 V in step ST45, the printer CPU 110 determines whether it is greater than 5.5 V and is equal to or less than 5.8 V (ST48). If the temporarily stored averaged value is greater than 5.5 V and is equal to or less than 5.8 V, the printer CPU 110 turns on the fresh toner hopper replenishment motor M1 for 3 seconds (ST49), turns off the recycled toner hopper replenishment motor M3, and finishes the replenishment operation switching control.

If the temporarily stored averaged value is greater than 5.8 V in step ST48, the printer CPU 110 requests the main CPU 91 to stop the image forming operation (ST51), starts the forcible toner replenishment mode (ST52), requests the main CPU 91 to display toner empty information (ST53), and finishes the replenishment operation switching control.

As has been described above, in the first embodiment, in the case where the count value of the counter 115*a* is between zero and "250" (the number of sheets fed) after the release of the forcible toner replenishment mode and the toner density sensor 17 indicates the necessity of toner replenishment, only fresh toner is replenished by a predetermined amount in accordance with the detection level of the toner density sensor 17, and recycled toner is not replenished.

In addition, in the first embodiment, in the case where the count value of the counter 115*a* is greater than "250" (the number of sheets fed) after the release of the forcible toner replenishment mode and the toner density sensor 17 indicates the necessity of toner replenishment, both fresh toner and recycled toner are replenished by predetermined amounts in accordance with the detection level of the toner density sensor 17.

As has been described above, according to the first embodiment, in the toner replenishment operation following the release of the forcible toner replenishment mode, only fresh toner, or both fresh toner and recycled toner, are replenished by predetermined amounts in accordance with the detection level of the toner density sensor 17. Thereby, the probability of occurrence of image fogging in the image forming operation after the release of the forcible toner replenishment mode can be reduced.

A second embodiment of the present invention will now be described.

In the first embodiment, after the release of the forcible toner replenishment mode, in the image forming operation in any environment, the recycled toner replenishment is stopped and only the fresh toner is replenished until a predetermined number of sheets are fed. Thereby, the probability of the occurrence of image fogging is reduced.

However, in the high-humidity environment, image fogging occurs frequently and recycled toner cannot effectively be used as in the normal-humidity or low-humidity environment.

In the second embodiment, the humidity sensor 55 attached to the machine detects the environmental condition (humidity) of the machine. The replenishment of recycled toner in the image forming operation after the release of the forcible toner replenishment mode can be varied in accordance with the detection level indicated by the humidity sensor 55.

Figure 16:
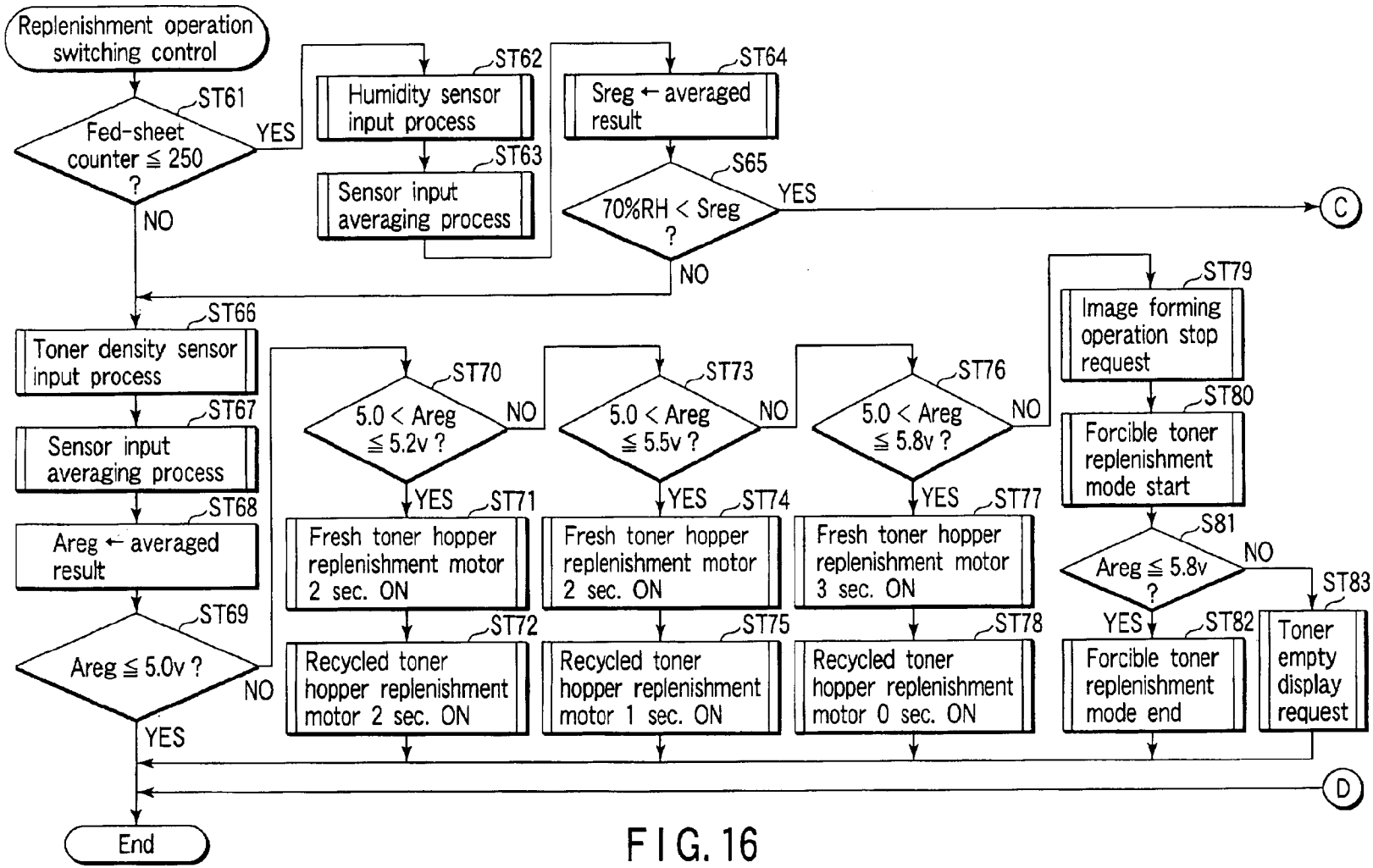
FIG. 16 is a flowchart illustrating toner replenishment operation switching control according to a second embodiment.
Figure 17:
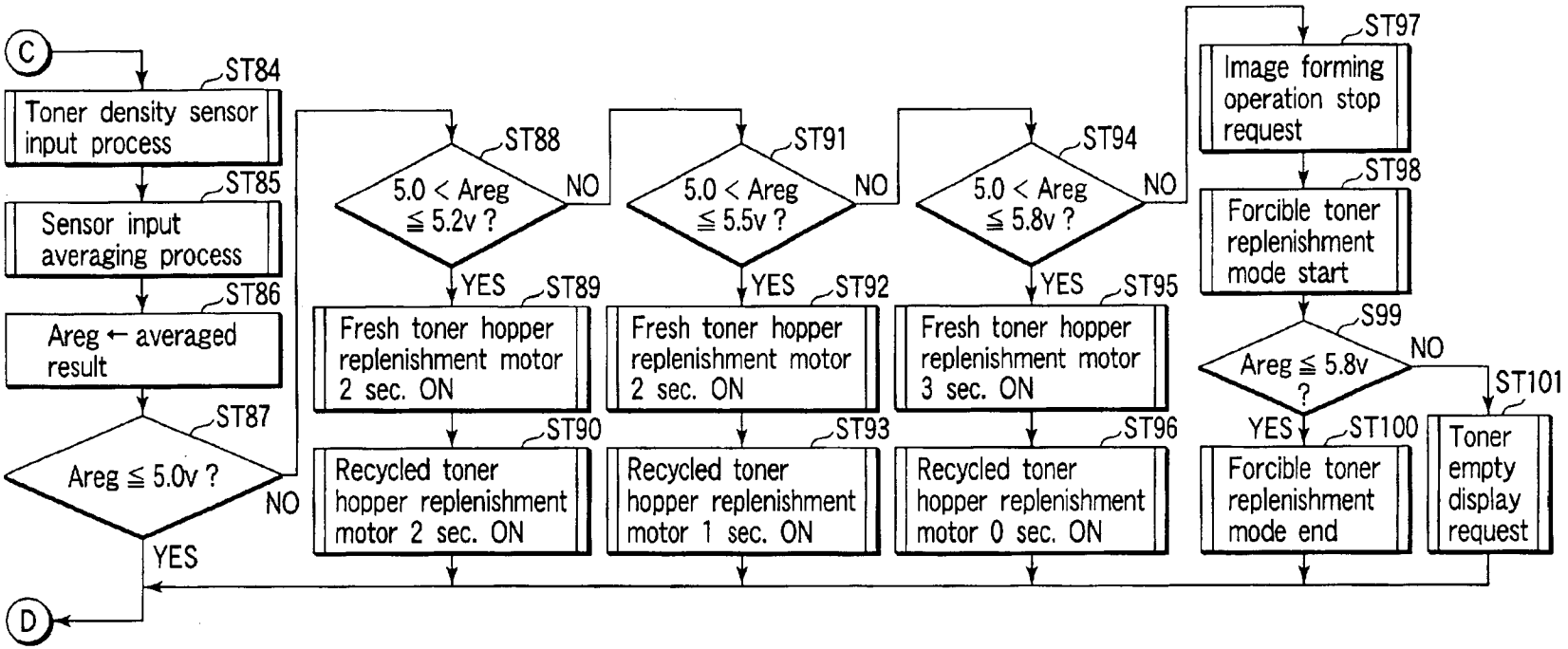
FIG. 17 is a flowchart illustrating toner replenishment operation switching control according to the second embodiment.

Toner replenishment operation switching control according to the second embodiment of the present invention will now be described with reference to the flowcharts of FIGS. 16 and 17.

When the forcible toner replenishment mode is released, the printer CPU 110 confirms the count value of the counter 115*a* (ST61).

If the count value of the counter 115*a* is between zero and "250" (the number of sheets fed), the printer CPU 110 performs the humidity sensor input process in connection with the input from the humidity sensor 55 (ST62). The printer CPU 110 averages the input value from the humidity sensor 55 (ST63) and temporarily stores (Areg) the averaged result (ST64).

The printer CPU 110 determines whether the temporarily stored averaged result is greater than 70% RH (ST65). If it is equal to or less than 70% RH, the printer CPU 110 advances to step ST66.

If the count value of the counter 115*a* is "250" (the number of sheets fed) or more, the printer CPU 110 advances to step ST66.

In step ST66, the printer CPU 110 performs the toner density sensor input process in connection with the input from the toner density sensor 17 (ST66). The printer CPU 110 then performs a sensor input averaging process to average the input value from the toner density sensor 17 (ST67) and temporarily stores (Areg) the averaged result (ST68).

The printer CPU 110 determines whether the temporarily stored averaged result is equal to or less than 5.0 V (ST69). If it is equal to or less than 5.0 V, the printer CPU 110 finishes the replenishment operation switching control.

If the temporarily stored averaged value is greater than 5.0 V in step ST69, the printer CPU 110 determines whether it is greater than 5.0 V and is equal to or less than 5.2 V (ST70). If the temporarily stored averaged value is greater than 5.0 V and is equal to or less than 5.2 V, the printer CPU 110 turns on the fresh toner hopper replenishment motor M1 for two seconds (ST71), turns on the recycled toner hopper replenishment motor M3 for two seconds (ST72), and finishes the replenishment operation switching control.

If the temporarily stored averaged value is greater than 5.2 V in step ST70, the printer CPU 110 determines whether it is greater than 5.2 V and is equal to or less than 5.5 V (ST73). If the temporarily stored averaged value is greater than 5.2 V and is equal to or less than 5.5 V, the printer CPU 110 turns on the fresh toner hopper replenishment motor M1 for two seconds (ST74), turns on the recycled toner hopper replenishment motor M3 for one second (ST75), and finishes the replenishment operation switching control.

If the temporarily stored averaged value is greater than 5.5 V in step ST73, the printer CPU 110 determines whether it is greater than 5.5 V and is equal to or less than 5.8 V (ST76). If the temporarily stored averaged value is greater than 5.5 V and is equal to or less than 5.8 V, the printer CPU 110 turns on the fresh toner hopper replenishment motor M1 for three seconds (ST77), turns on the recycled toner hopper replenishment motor M3 for zero seconds (i.e. stops the motor M3) (ST78), and finishes the replenishment operation switching control.

If the temporarily stored averaged value is greater than 5.8 V in step ST76, the printer CPU 110 requests the main CPU 91 to stop the image forming operation (ST79), and starts the forcible toner replenishment mode (ST80).

Then, the printer CPU 110 determines whether the input voltage (Areg) from the toner density sensor 17 in the forcible toner replenishment mode is equal to or less than 5.5 V (ST81).

If the input voltage is equal to or less than 5.5 V in step ST81, the printer CPU 110 finishes the forcible toner replenishment mode (ST82). If it is greater than 5.5 V, the printer CPU 110 requests the main CPU 91 to display toner empty information (ST83), and finishes the replenishment operation switching control.

If the temporarily stored averaged result is greater than 70% RH in step ST65, the printer CPU 110 performs the toner density sensor input process in connection with the input from the toner density sensor 17 (ST84). The printer CPU 110 averages the input value from the toner density sensor 17 (ST85) and temporarily stores (Areg) the averaged result (ST86).

The printer CPU 110 determines whether the temporarily stored averaged result is equal to or less than 5.0 V (ST87). If it is equal to or less than 5.0 V, the printer CPU 110 finishes the replenishment operation switching control.

If the temporarily stored averaged value is greater than 5.0 V in step ST87, the printer CPU 110 determines whether it is greater than 5.0 V and is equal to or less than 5.2 V (ST88). If the temporarily stored averaged value is greater than 5.0 V and is equal to or less than 5.2 V, the printer CPU 110 turns on the fresh toner hopper replenishment motor M1 for two seconds (ST89), turns off the recycled toner hopper replenishment motor M3 (ST90), and finishes the replenishment operation switching control.

If the temporarily stored averaged value is greater than 5.2 V in step ST88, the printer CPU 110 determines whether it is greater than 5.2 V and is equal to or less than 5.5 V (ST91). If the temporarily stored averaged value is greater than 5.2 V and is equal to or less than 5.5 V, the printer CPU 110 turns on the fresh toner hopper replenishment motor M1 for two seconds (ST92), turns off the recycled toner hopper replenishment motor M3 (ST93), and finishes the replenishment operation switching control.

If the temporarily stored averaged value is greater than 5.5 V in step ST91, the printer CPU 110 determines whether it is greater than 5.5 V and is equal to or less than 5.8 V (ST94). If the temporarily stored averaged value is greater than 5.5 V and is equal to or less than 5.8 V, the printer CPU 110 turns on the fresh toner hopper replenishment motor M1 for three seconds (ST95), turns off the recycled toner hopper replenishment motor M3 (ST96), and finishes the replenishment operation switching control.

If the temporarily stored averaged value is greater than 5.8 V in step ST94, the printer CPU 110 requests the main CPU 91 to stop the image forming operation (ST97), and starts the forcible toner replenishment mode (ST98).

Then, the printer CPU 110 determines whether the input voltage (Areg) from the toner density sensor 17 in the forcible toner replenishment mode is equal to or less than 5.5 V (ST99).

If the input voltage is equal to or less than 5.5 V in step ST99, the printer CPU 110 finishes the forcible toner replenishment mode (ST100). If it is greater than 5.5 V, the printer CPU 110 requests the main CPU 91 to display toner empty information (ST101), and finishes the replenishment operation switching control.

As has been described above, according to the second embodiment, the following toner replenishment control is performed. After the release of the forcible toner replenishment mode, if the count value of the counter 115*a* is between zero and "250" (the number of sheets fed), the output of the humidity sensor 55 is greater than 70% RH and the toner density sensor 17 indicates the necessity of toner replenishment, only fresh toner is replenished by a predetermined amount in accordance with the detection level of the toner density sensor 17 and recycled toner is not replenished.

In addition, according to the second embodiment, the following toner replenishment control is performed. After the release of the forcible toner replenishment mode, if the count value of the counter 115*a* is greater "250" (the number of sheets fed), the output of the humidity sensor 55 is greater than 70% RH and the toner density sensor 17 indicates the necessity of toner replenishment, both fresh toner and recycled toner are replenished by predetermined amounts in accordance with the detection level of the toner density sensor 17.

Furthermore, according to the second embodiment, the following toner replenishment control is performed. After the release of the forcible toner replenishment mode, if the count value of the counter 115*a* is greater "250" (the number of sheets fed) and the toner density sensor 17 indicates the necessity of toner replenishment regardless of the output of the humidity sensor 55, both fresh toner and recycled toner are replenished by predetermined amounts in accordance with the detection level of the toner density sensor 17.

In the present invention, the kind of the developer can be altered.

Assume, for example, that the kind of the developer is altered and that image fogging frequently occurs within the number of sheets of 50 in the normal-humidity environment due to recycled toner replenishment after the release of the forcible toner replenishment mode, and image fogging frequently occurs within the range of the number of sheets of 500 in the high-humidity environment.

In this case, if the relative humidity exceeds 70% RH, recycled toner replenishment after the release of the forcible toner replenishment mode is halted within the range of the number of sheets of 500.

If the relative humidity is between 70% RH and 35% RH, recycled toner replenishment after the release of the forcible toner replenishment mode is halted within the range of the number of sheets of 50.

If the relative humidity is less than 35% RH, recycled toner replenishment after the release of the forcible toner replenishment mode is halted within the range of the number of sheets of 0 (i.e. recycled toner replenishment is not halted).

According to the above-described present invention, it is possible to cope with environments by altering the control mode in accordance with the magnitude of variation in environment of the developer or the level of occurrence of image fogging at the time of recycled toner replenishment.

As has been described above, according to the embodiments of the present invention, at the time of the image forming operation after the forcible toner replenishment mode, high-quality image formation can be performed with less occurrence of image fogging in any environment.

Moreover, the time of stopping recycled toner replenishment is varied in accordance with the humidity. Thereby, recycled toner can be used with maximum efficiency while the occurrence of image fogging is kept low.

In the embodiments of the present invention, the fresh toner replenishment and recycled toner replenishment are controlled on the basis of predetermined numbers of sheets fed. However, the fresh toner replenishment and recycled toner replenishment are controlled on the basis of the operation time of the developing device.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus having a photosensitive body that forms an electrostatic latent image, and forming an image, the apparatus comprising:

a developing section that effects development on the photosensitive body with the formed electrostatic latent image by using a developer;

a first replenishment section that replenishes fresh developer to the developing section;

a second replenishment section that replenishes recovered developer to the developing section;

a first detection section that detects a state of the developer in the developing section;

a second detection section that detects an environmental state near the developing section; and a control section that effects control to replenish fresh toner from the first replenishment section and recovered developer to the developing section from the second replenishment section in accordance with a detection result of the firs detection section and a detection result of the second detection section for a predetermined time period, when forcible replenishment of fresh developer to the developing section from the first replenishment section is completed, wherein the control section effects control to replenish only fresh developer to the developing section from the first replenishment section in accordance with a detection result of the first detection section for a predetermined time period, when humidity detected as the environmental state by the second detection section has exceeded a predetermined value.

2. An image forming apparatus according to claim 1, wherein the second replenishment section replenishes the developer obtained by recovering a residual developer remaining on the photosensitive body.

3. An image forming apparatus according to claim 1, wherein the first detection section is a sensor that detects developer density in the developing section.

4. An image forming apparatus according to claim 1, wherein the second detection section is a sensor that detects humidity near the developing section.

5. An image forming apparatus having a photosensitive body that forms an electrostatic latent image, and forming an image, the apparatus comprising:

a developing section that effects development on the photosensitive body with the formed electrostatic latent image by using a developer;

a first replenishment section that replenishes fresh developer to the developing section;

a second replenishment section that replenishes recovered developer to the developing section;

a first section that detects a state of the developer in the developing section;

a second detection that detects an environmental state near the developing section; and a control section that effects control to replenish fresh toner from the first replenishment section, and recovered developer to the developing section from the second replenish section in accordance with a detection result of the first detection second and a detection result of the second detection section for a predetermined time period, when forcible replenishment of fresh developer to the developing section from the first replenishment section is completed, wherein the control section effects control to replenish fresh developer from the first replenishment section and recovered developer from the second replenishment section to the developing section in accordance with a detection result of the first detection section for a predetermined time period, when humidity detected as the environmental state by the second detection section is less than a predetermined value.

6. An image forming apparatus according to claim 5, wherein the second replenishment section replenishes the developer obtained by recovering a residual developer remaining on the photosensitive body.

7. An image forming apparatus according to claim 5, wherein the first detection section is a sensor that detects developer density in the developing section.

8. An image forming apparatus according to claim 5, wherein the second detection section is a sensor that detects humidity near the developing section.

9. A developer replenishment control method for replenishing developer to a developing section that effects development on a photosensitive body with an electrostatic latent image formed, the method comprising:

effecting control to replenish only fresh developer to the developing section in accordance with a detection result of a state of the developer in the detection section for a predetermined time period; and effecting control to replenishment fresh toner and recovered developer to the developing section in accordance with a detection result of the state of the developer in the detection section, when said predetermined time period has elapsed, wherein control is effected to replenish only fresh developer to the developing section in accordance with a detection result of the state of the developer in the developing section for a predetermined time period, when humidity near the developing section has exceeded a predetermined value.

10. An image forming method using a photosensitive body that forms an electrostatic latent image, a developing section that effects development using the photosensitive body as a developer, a first replenishment section that replenishes a fresh developer to the developing section, and a second replenishment section that replenishes a recovered developer to the developing section, the image forming method comprising:

detecting, using a first detection section, a state of the developer in the developing section;

detecting, using a second detection section, an environmental state near the developing section; and effecting control to replenish the developing section with the fresh developer from the first replenishment section and with the recovered developer from the second replenishment section for a predetermined time period in accordance with a detection result of the state of the developer in the developing section, wherein the replenishment is performed when forcible replenishment of the fresh developer to the developing section from the first replenishment section is completed and humidity detected as the environmental state by the second detection section is less than or equal to a predetermined value.

11. An image forming apparatus having a photosensitive body that forms an electrostatic latent image, comprising:

developing means for effecting development on the photosensitive body with the electrostatic latent image formed thereon, the development being effected using a developer;

first replenishment means for replenishing a fresh developer to the developing means;

second replenishment means for replenishing a recovered developer to the developing means;

first detection means for detecting a state of the developer in the developing means;

second detection means for detecting an environmental state near the developing means; and control means for controlling replenishment of the developing means with only the fresh developer from the first replenishment means, wherein the replenishment is performed for a predetermined time period in accordance with a detection result of the first detection means when forcible replenishment of the fresh developer to the developing section from the first replenishment section is completed and humidity detected as the environmental state by the second detection means exceeds a predetermined value.

12. An image forming apparatus according to claim 11, wherein the second replenishment means replenishes the developer obtained by recovering a residual developer remaining on the photosensitive body.

13. An image forming apparatus according to claim 11, wherein the first detection means is a sensor that detects developer density in the developing means.

14. An image forming apparatus according to claim 11, wherein the second detection means is a sensor that detects humidity near the developing means.

15. An image forming apparatus having a photosensitive body that forms an electrostatic latent image, comprising:

developing means for effecting development on the photosensitive body with the electrostatic latent image formed thereon, the development being effected using a developer;

first replenishment means for replenishing a fresh developer to the developing means;

second replenishment means for replenishing a recovered developer to the developing means;

first detection means for detecting a state of the developer in the developing means;

second detection means for detecting an environmental state near the developing means; and control means for controlling replenishment of the developing means with the fresh developer from the first replenishment section and the recovered developer from the second replenishment section, wherein the replenishment is performed for a predetermined time period in accordance with a detection result of the state of the first detection means when forcible replenishment of the fresh developer to the developing means from the first replenishment means is completed and humidity detected as the environmental state by the second detection means is less than or equal to a predetermined value.

16. An image forming apparatus according to claim 15, wherein the second replenishment means replenishes the developer obtained by recovering a residual developer remaining on the photosensitive body.

17. An image forming apparatus according to claim 15, wherein the first detection means is a sensor that detects developer density in the developing means.

18. An image forming apparatus according to claim 15, Wherein the second detection means is a sensor that detects humidity near the developing means.

* * * * *